US009548536B2

(12) United States Patent
Ardavan et al.

(10) Patent No.: US 9,548,536 B2
(45) Date of Patent: Jan. 17, 2017

(54) FEED NETWORK AND ELECTROMAGNETIC RADIATION SOURCE

(71) Applicants: COMMSCOPE, INC. OF NORTH CAROLINA, Hickory, NC (US); LOS ALAMOS NATIONAL SECURITY, LLC, Los Alamos, NM (US); OXBRIDGE PULSAR SOURCES LIMITED, Cambridge (GB)

(72) Inventors: Arzhang Ardavan, Oxford (GB); John Singleton, Los Alamos, NM (US); Kevin E. Linehan, Rowlett, TX (US); Houshang Ardavan, Cambridge (GB); Andrea Caroline Schmidt-Zwiefel, Los Alamos, NM (US)

(73) Assignees: COMMSCOPE INC. OF NORTH CAROLINA, Hickory, NC (US); LOS ALAMOS NATIONAL SECURITY, LLC, Los Alamos, NM (US); OXBRIDGE PULSAR SOURCES LTD., Cambridge (GB)

( * ) Notice: Subject to any disclaimer, the term of this patent is extended or adjusted under 35 U.S.C. 154(b) by 21 days.

(21) Appl. No.: 14/651,504

(22) PCT Filed: Dec. 17, 2013

(86) PCT No.: PCT/US2013/075812

§ 371 (c)(1),
(2) Date: Jun. 11, 2015

(87) PCT Pub. No.: WO2014/100008

PCT Pub. Date: Jun. 26, 2014

(65) Prior Publication Data

US 2015/0325914 A1 Nov. 12, 2015

Related U.S. Application Data

(60) Provisional application No. 61/738,836, filed on Dec. 18, 2012.

(51) Int. Cl.
*H01Q 1/50* (2006.01)
*H01Q 3/34* (2006.01)
(Continued)

(52) U.S. Cl.
CPC ..... *H01Q 3/34* (2013.01); *H01Q 3/30* (2013.01); *H01Q 13/28* (2013.01); *H01Q 21/0075* (2013.01)

(58) Field of Classification Search
CPC ..... H01Q 3/30; H01Q 21/00
(Continued)

(56) References Cited

U.S. PATENT DOCUMENTS 6,147,648 A * 11/2000 Granholm ..... H01Q 21/24 343/700 MS
6,650,178 B1 * 11/2003 Brankovic ..... H03D 9/04 329/304
2010/0039324 A1 * 2/2010 Singleton ..... H01Q 3/34 342/374

FOREIGN PATENT DOCUMENTS

JP 2010 193052 A 2/2010
WO WO 02/07254 A1 1/2002

OTHER PUBLICATIONS

PCT International Preliminary Report, PCT Written Opinion of the International Searching Authority, Jul. 2, 2015 PCT/US2013/75812 (13 page).

(Continued)

*Primary Examiner* — Peguy Jean Pierre
(74) *Attorney, Agent, or Firm* — Hahn Loeser & Parks, LLP

(57) ABSTRACT

An antenna may include a volume polarization current radiator and a feed network. The volume polarization current radiator, includes a dielectric solid (such as a dielectric strip), and a plurality of closely-spaced excitation elements (24), each excitation element (24) being configured to induce a volume polarization current distribution in the dielectric solid proximate to the excitation element when a voltage is applied to the excitation element. The feed network is coupled to the volume polarization current radiator. The feed network also includes a plurality of passive power divider elements (32) and a plurality of passive delay elements (d1-d6) coupling the first port (30) and the plurality of second ports (108, 109, 164), the plurality of power (Continued)

divider elements (32) and the plurality of phase delay elements (d1-d6) being configured such that a radio-frequency signal that is applied to the first port (30) experiences a progressive change of phase as it is coupled to the plurality of second ports (108, 109, 164) so as to cause the volume polarization current distribution to propagate along the dielectric solid.

23 Claims, 7 Drawing Sheets

(51) Int. Cl.
*H01Q 3/30* (2006.01)
*H01Q 13/28* (2006.01)
*H01Q 21/00* (2006.01)

(58) Field of Classification Search
USPC ..... 343/850, 700 MS, 856, 893, 857, 821
See application file for complete search history.

(56) References Cited

OTHER PUBLICATIONS

International Search Report regarding PCT/US2013/075812, mailed Apr. 3, 2014 (6pgs.).
Written Opinion regarding PCT/US2013/075812, mailed Apr. 3, 2014 (12pgs.).
Singleton et al., Oct. 26, 2011, http://laacg.lanl.gov/superluminal/pubs/DRsummary.pdf (77 pgs.).
Singleton et al. Sep. 27, 2004, XP010795127, pp. 591-592; ISBN: 978-0-7803-8490-3 (2pgs.).
Translation of JP 2010 193052 A, Thomson Scientific, Mar. 25, 2014 (14pgs.).

* cited by examiner

FEED NETWORK AND ELECTROMAGNETIC RADIATION SOURCE

STATEMENT REGARDING FEDERAL RIGHTS

This invention was made in part with government support under Contract No. DE-AC52-06NA25396 awarded to Los Alamos National Security, LLC (LANS) by the U.S. Department of Energy and made in part under CRADA number LA11C10646 between CommScope, Inc. of North Carolina and LANS. The government has certain rights in the invention.

This application claims priority to U.S. Provisional Application Ser. No. 61/738,836, filed Dec. 18, 2012, Pursuant to 35 U.S.C. §120.

BACKGROUND OF INVENTION

Passive feed networks have been known to be combined with discrete-element antenna arrays. These known antenna arrays typically have dipole or patch radiating elements. By providing a progressive, constant-difference phase shift to the point-source radiating elements, a beam pattern produced by the antenna may be steered from perpendicular with respect to the antenna face.

Such known steerable arrays typically have from 5-15 discrete radiating elements. Some antenna arrays may have more radiating elements. However, the dipole or patch radiating elements are discrete radiating elements. They are typically driven separately, and operate as point sources. Additionally, the dipole or patch radiating elements generate an electromagnetic field by surface current.

Another type of antenna comprises a strip of dielectric with a series of polarization devices. Each polarization device may comprise, for example, a pair of electrodes separated by the dielectric. As the electrodes are driven, a displacement current occurs in the dielectric. This displacement (or volume polarization) current within the dielectric radiates an electromagnetic field. Thus, this type of element is considered a volume polarization source of electromagnetic radiation. The volume polarization current distribution may be caused to propagate by appropriate sequencing of the energization of the polarization devices. Known volume source arrays have elements that are driven by individual amplifiers. See, for example, U.S. Pat. No. 8,125,385, which is incorporated by reference.

Volume polarization current sources of electromagnetic radiation whose distribution patterns move faster than light in vacuum have been experimentally realized. One example of a superluminal source that has already been constructed and tested functions by producing a polarization current with a rotating distribution pattern in a ring-shaped dielectric (such as alumina); by a phase-controlled excitation of voltages applied to electrodes that surround the dielectric, the polarization pattern can be set in motion with superluminal speed and centripetal acceleration. See, e.g., U.S. Pat. Pub. No. 2006/0192504; see also, U.S. application Ser. No. 13/368,200, titled "Superluminal Antenna" and filed on Feb. 7, 2012, the disclosures of which are incorporated by reference. These devices produce tightly-focused packets of electromagnetic radiation fundamentally different from the emissions of conventional sources.

Once a source travels faster than light with acceleration, it can make contributions at multiple retarded times to a signal received instantaneously at a distance. For those volume elements of an extended source that approach the observation point, along the radiation direction, with the speed of light and zero acceleration, these multiple contributions coalesce and give rise to a focusing of the received waves in the time domain: the interval of observation time during which a particular set of wave fronts is received is considerably shorter than the interval of retarded time during which the same set of waves is emitted by such source elements. As a result, part of the emitted radiation possesses an intensity that decays nonspherically with the distance d from the source: as 1/d rather than as the conventional inverse square law, $1/d^2$. This does not contravene the conservation of energy. The constructively interfering waves from the particular set of elements responsible for the nonspherically decaying signal at a given observation point constitute a beam that narrows with distance. The area subtended by the beam increases as d, rather than $d^2$, so that the flux of energy remains the same across all cross sections of the beam. In that it consists of caustics and so is constantly dispersed and reconstructed out of other waves, the beam in question is, of course, radically different from a conventional radiation beam.

Another example of a superluminal source is one for which the polarization distribution pattern moves rectilinearly. In one example, the polarization distribution pattern moves with an acceleration that increases linearly with its displacement from a negative to a positive value. When its speed exceeds the speed of light in vacuo on the plane where its acceleration vanishes, this source, too, generates an emission whose intensity diminishes as 1/d. The morphology of the nonspherically decaying radiation beam generated by the present source is very different from that of the radiation beam that is generated by a centripetally accelerated superluminal source. While the beam generated by a rotating superluminal source consists of a collection of nondiffracting subbeams that are observable over a wide solid angle, in the present case, the nonspherically decaying component of the radiation propagates into a narrowing beam at a fixed angle relative to the direction of motion of the source. This beam is nondiffracting in one dimension: its angular width normal to the direction of motion of the source decreases as 1/d, instead of being constant, so that its cross sectional area increases as d, rather than $d^2$, with the distance d from the source.

Heretofore, these examples of superluminal sources were generated by amplifiers individually driving each polarization device of a radiating source. The large number of amplifiers increases the cost and may adversely affect mean time before failure (MTBF) of such sources.

SUMMARY OF THE INVENTION

An antenna according to one aspect of the present invention may include a volume polarization current radiator and a feed network. The volume polarization current radiator includes a dielectric solid (such as a dielectric strip) and a plurality of closely-spaced excitation elements, each excitation element being configured to induce a volume polarization current distribution in the dielectric solid proximate to the excitation element when a voltage is applied to the excitation element. The feed network is coupled to the volume polarization current radiator. The feed network includes a first port and a plurality of second ports. Each of the plurality of second ports may be coupled to at least one of the plurality of excitation elements. The feed network also includes a plurality of passive power divider elements and a plurality of passive delay elements coupling the first port and the plurality of second ports, the plurality of power divider elements and the plurality of phase delay elements being configured such that a radio-frequency signal that is applied to the first port experiences a progressive change of phase as it is coupled to the plurality of second ports so as to cause the volume polarization current distribution to propagate along the dielectric solid.

According to one aspect of the invention, the progressive change of phase is implemented as a progressive change of time delay between the first port and at least some of the plurality of second ports. In other examples, the progressive change of phase comprises adding phase delay in approximately equal amounts and/or adding phase delay in diminishing amounts.

The dielectric solid may be a linear strip, a curved strip, a circular strip, or any other suitable shape.

The power divider elements and the phase delay elements may be configured such that when a radio-frequency signal is applied to the first port, the phase of the radio-frequency signal is progressively changed as it is coupled to the plurality of second ports so as to cause the volume polarization current distribution to propagate along the dielectric solid at a velocities which may be greater than, less than, or the same as the speed of light in a vacuum. Additionally, the phase of the radio-frequency signal may be progressively changed as it is coupled to the plurality of second ports so as to cause the volume polarization current distribution to accelerate while propagating along the dielectric solid.

In another aspect of the invention, the plurality of closely spaced excitation elements may comprise a first excitation element and a second excitation element, where the first excitation element is adjacent to the second excitation element, and where a center of the first excitation element is separated from a center of a second excitation element by an element distance. The feed network may impose a first aggregate amount of time delay between the first port and the first excitation element and a second aggregate amount of time delay between the first port and the second excitation element. The first aggregate amount of time delay in this example is less than the second aggregate amount of time delay. The element distance may be greater than or less than a difference between the first aggregate amount of time delay and the second aggregate amount of time delay.

The plurality of closely spaced excitation elements may further include a third excitation element. In this example, the second excitation element is adjacent to the third excitation element, and the center of the second excitation element is separated from a center of a third excitation element by the element distance. The feed network imposes a third aggregate amount of time delay between the first port and the third excitation element, the third aggregate amount of time delay being greater than the second aggregate amount of time delay.

In one example, the element distance may be greater than a difference between the first aggregate amount of time delay and the second aggregate amount of time delay; and a difference between the second aggregate amount of time delay and the third aggregate amount of time delay may be less than the difference between the first aggregate amount of time delay and the second aggregate amount of time delay.

The passive delay elements may comprise a fixed-length transmission line that imparts a fixed amount of time delay. In another example, at least one of the plurality of passive delay elements comprises an adjustable phase shifter that imparts a variable amount of time delay. In another example, both adjustable phase shifters and fixed-length transmission lines may be used.

DETAILED DESCRIPTION OF INVENTION

Figure 1:
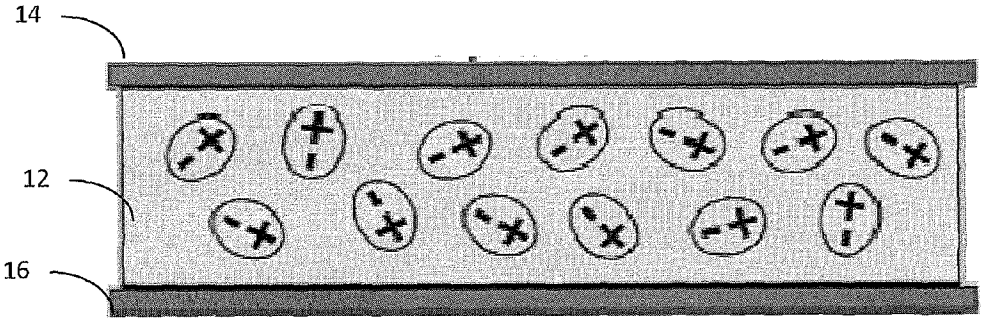
FIG. 1 shows a simplified dielectric solid.

According to the embodiment(s) of the present invention, various views are illustrated in FIGS. 1-9 and like reference numerals are being used consistently throughout to refer to like and corresponding parts of the invention for all of the various views and figures of the drawing.

As explained in more detail below, the antenna may include a volume polarization current distribution radiator and a passive feed network. The volume polarization current distribution radiator comprises, in one example, a plurality of polarization devices, such as a plurality of electrodes, and a dielectric strip. The electrodes may be coupled above and a ground plate coupled below the dielectric. The dielectric has a finite polarization region created by selectively applying a positive voltage to one or more electrodes. The passive feed network is coupled to the polarization devices. The passive feed network receives a modulated Radio-Frequency (RF) signal and applies the RF signal according to power and phase relationships as set forth in an excitation profile. The excitation profile is selected such that the volume polarization current distribution propagates along the dielectric strip.

In a conventional phased array antenna, each radiating element may be considered a point source of electromagnetic radiation. The radiating elements may be separated by a distance proportional to the wavelength of the RF signal radiated by the radiating element. Also, the electromagnetic radiation is generated by surface current, such as on dipole elements.

In contrast to such point-source electromagnetic radiation sources, the present invention drives the antenna such that it produces a continuous, moving source of electromagnetic radiation. Additionally, the electromagnetic radiation is generated by a volume polarization current, not surface current.

The production and propagation of electromagnetic radiation is described by the following two Maxwell equations:

$$\nabla \times E = \partial B/\partial t \quad (1)$$

$$\nabla \times H = J_{free} + \epsilon_0 \partial E/\partial t + \partial P/\partial t \quad (2)$$

(SI units). Here H is the magnetic field strength, B is the magnetic induction, P is polarization, and E is the electric field; the (coupled) terms in B, E and H of Eqs. 1 and 2 describe the propagation of electromagnetic waves. The generation of electromagnetic radiation is encompassed by the source terms $J_{free}$ (the current density of free charges) and $\partial P/\partial t$ (the polarization current density). An oscillating $J_{free}$ is the basis of conventional radio transmitters. The charged particles that make up $J_{free}$ have finite rest mass, and therefore cannot move with a speed that exceeds the speed of light in vacuo. Practical superluminal sources employ a polarization current to generate electromagnetic radiation, which is represented by the polarization current density $\partial P/\partial t$.

Figure 2:
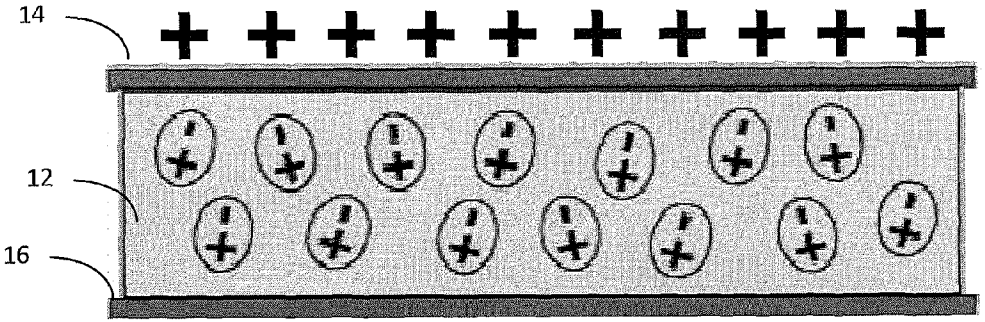
FIG. 2 shows a simplified dielectric solid with an electric field applied.

The principles of such sources are outlined in FIGS. 1-4. FIG. 1 shows a simplified dielectric solid 12. The dielectric solid is an electrical insulator that may be polarized by applying an electric field. When an electric field is applied, electric charges in the dielectric slightly shift from their average equilibrium positions causing dielectric polarization. Because of dielectric polarization, positive charges are displaced toward the field and negative charges shift in the opposite direction. An electrode 14 is on one side of the dielectric 12 and a ground plane 16 is on the other. No electric field is applied by the electrodes or ground plane, so the charges are shown as randomly oriented to indicate that they are in their average equilibrium positions. In FIG. 2, an electric field has been applied, causing the positive and negative charges to shift slightly from their average equilibrium positions to move in opposite directions. A finite polarization P has therefore been induced. A changing state of polarization P corresponds to charge movement, and so is equivalent to current.

Figure 3:
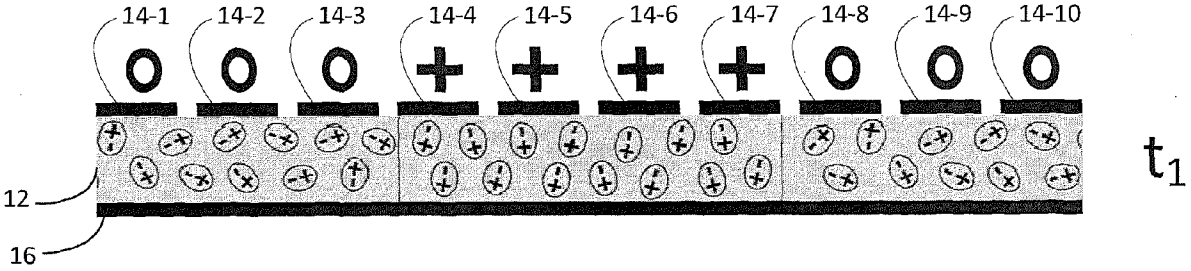
FIG. 3 illustrates a dielectric with a spatially-varying field at time $t_1$.
Figure 4:
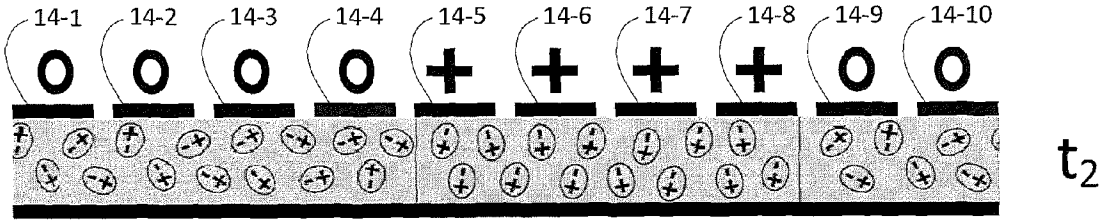
FIG. 4 illustrates a dielectric with a spatially-varying file d at time $t_2$.

Referring to FIGS. 3 and 4, if the distribution pattern of the spatially-varying field is made to move, then the polarized region moves with it; thereby producing a traveling "wave" of P (and also, by virtue of the time dependence imposed by movement, a traveling wave of $\partial P/\partial t$). FIG. 3 illustrates the position of the polarized region at time $t_1$. Electrodes 14-1, 14-2, and 14-3 are not energized. A voltage is applied to electrodes 14-4, 14-5, 14-6, and 14-7. Electrodes 14-8, 14-9, and 14-10 are not energized. In this state, an electric field exists between electrodes 14-4 through 14-7 and the ground plane, and therefore a polarized region also exists adjacent to electrodes 14-4 through 14-7. The state of the system at time $t_2$ is illustrated in FIG. 4. At time $t_2$, electrode 14-4 is not energized and a voltage is applied to electrode 14-8. The electric field, and therefore the polarized region, has moved one electrode to the right. Note that this "wave" can move arbitrarily fast (i.e. faster than the speed of light in vacuo) because the individual charges suffer only small shifts perpendicular to the direction of the wave and therefore do not themselves move faster than light.

Figure 5A:
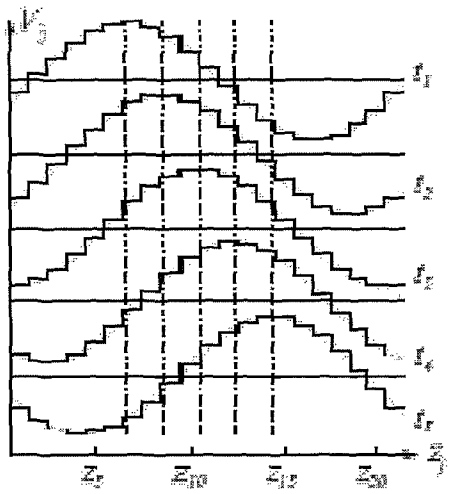
FIGS. 5*a* and 5*b* illustrates sequences of voltage to apply to electrodes to induce spatially-varying fields in a dielectric.
Figure 5B:
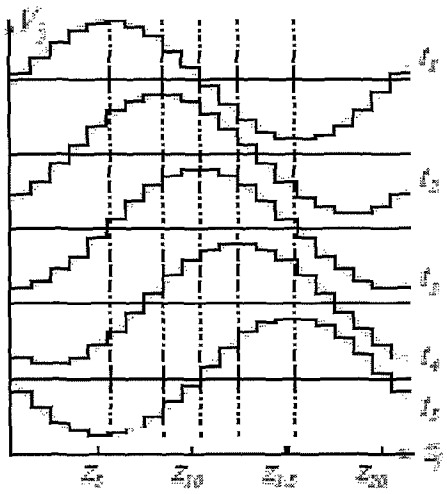
Figure 5C:
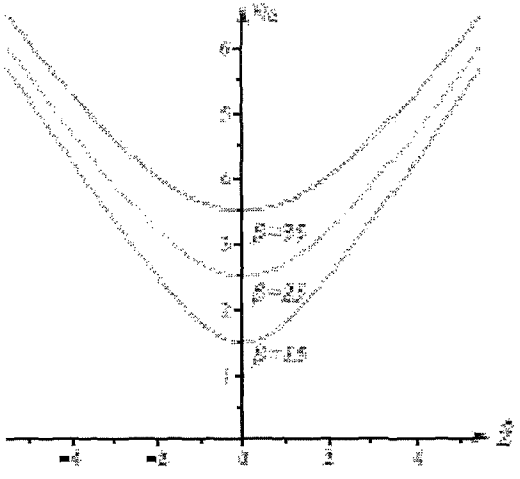
FIG. 5*c* illustrates aspects of the propagation velocity of a wave of a polarized dielectric.

Referring to FIGS. 5*a* and 5*b*, the voltage $V_j$ on each electrode pair versus the z coordinate $z_j$ (j=1, 2, 3, . . . ) of the center of that electrode at five equally-spaced consecutive times ($t_1<t_2<t_3<t_4<t_5$). The vertical dotted lines designate the corresponding consecutive positions of the constant-phase surface on which $V_j$ is maximum. The sinusoidal curves represent the fundamental Fourier component of the discretized voltage distribution at various times. While sinusoidal curves are illustrated in this example, the invention is not limited to sinusoidal curves. Other waveforms may be employed to achieve any desired polarization current distribution. In FIG. 5*a*, $V_j \propto \cos[\omega(t-j\Delta t)]$, so that the constant phase difference $j\omega\Delta t$ between adjacent electrode pairs results in a sinusoidal wave of polarization that propagates to the right with the constant speed $(z_{j+1}-z_j)/\Delta t$. In one example, $z_{j+1}-z_j=1.087$ cm and $\omega/(2\pi)=2.5$ GHz; the resulting polarization pattern thus moves with a speed exceeding the speed of light in vacuo when $\omega\Delta t<0.042$ radians. In FIG. 5*b*, $V_j \propto \cos[\omega t-\arcsin h(\omega z_j/u)]$, so that the constant-phase surface (designated by the vertical dotted lines) on which $V_j$ is maximum propagates to the right with an acceleration that changes sign from negative to positive. The speed v of this constant-phase surface, i.e., the propagation speed of the resulting wave train of polarization, is plotted in FIG. 5*c* for $\beta$=1.5, 2.5 and 3.5, where $\beta$ is the ratio of a constant speed to the speed of light in vacuo.

Many types of polarization devices may be used to apply an electric field across a portion of a dielectric. In one example, a polarization device may comprise a pair of electrodes on opposite sides of a dielectric strip. In another example, a polarization device may comprise an electrode electrically coupled with a ground plane. In another example, a polarization device may comprise a feed probe in the middle of a dielectric element. In another example, a ground plane may be used in conjunction with the feed probe. In each of these examples, the polarization devices are preferably sized such that a plurality of polarization devices may be located closely adjacent to each other so that, when excited in a sequence, the polarization devices apply a stepped approximation of a continuous electric field distribution to the dielectric strip.

Figure 6:
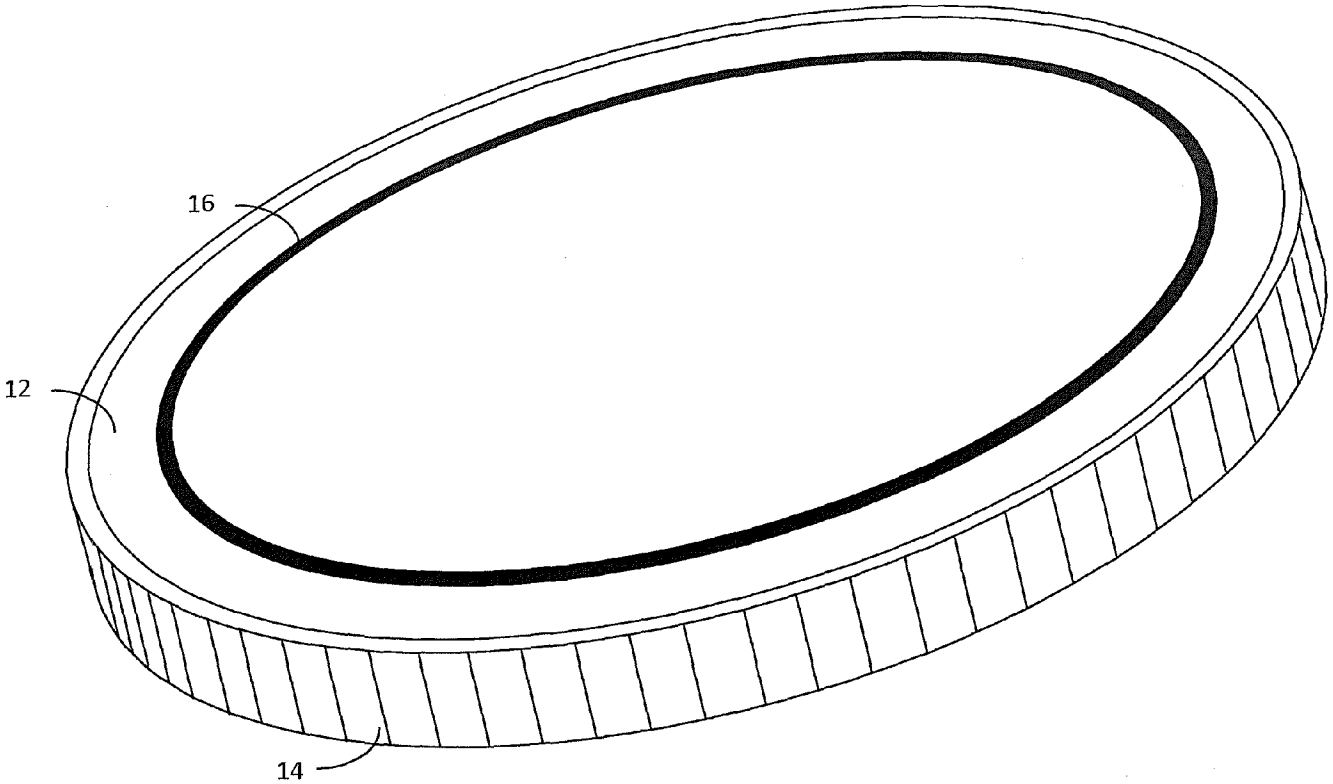
FIG. 6 illustrates a ring-shaped dielectric and antenna array.

In one example, illustrated in FIG. 6, the dielectric strip 12 is configured as a ring. Electrodes 14 are on the outer circumference of the ring, and a ground plane 16 is on the inner diameter. For a ring of radius r and a polarization pattern that moves around the ring with an angular frequency $\omega$, the velocity of the charged region is $r\omega$. In this example, $r\omega$ is greater than the speed of light c so that the moving polarization pattern also propagates at a speed greater than the speed of light. An azimuthal or radial polarization current may be produced by sequencing the electric field applied by each polarizing device relative to one another.

The voltages across neighboring electrode pairs have the same time dependence (their period is $2\pi/\omega$) but, as in the rectilinear case, there is a time difference of $\Delta t$ between the instants at which they achieve their maximum amplitude. The polarization pattern must move coherently around the ring, i.e. must move rigidly with an unchanging shape; this would be the case if $n\Delta t=2\pi N/\omega$, where n is the number of polarizing devices around the ring and N is an integer. Within the confines of this condition, the time dependence of the voltage across each polarizing device can be chosen at will. The exact form of the adopted time dependence would allow, for example, the generation of harmonic content and structure in the source. Modulation of the amplitude of this source at a frequency $\Omega$ would result in a radiation whose spectrum would contain frequencies of the order of $(\Omega/\omega)^2\Omega$.

For the circular radiator implementation, a polarization current $j=\partial P/\partial t$ produced by a polarization (the electric dipole moment per unit volume) in the dielectric can be of the following form:

$$P_{r,\phi,z,t}(r, \phi, z, t)=S_{r,\phi,z}(r, z)\cos(m\phi\hat{})\cos(\Omega t) \quad (3)$$

here $P_{r,\phi,z}$ are the components of the polarization (expressed in cylindrical polar coordinates), s(r, z) is a vector field describing the orientation of P (it vanishes outside the active volume of the source), $\hat{\phi}$ stands for the Lagrangian coordinate $\phi-\omega t$, $\omega m$ and $\Omega$ are the two angular frequencies used in the synthesis of the source.

Figure 7:
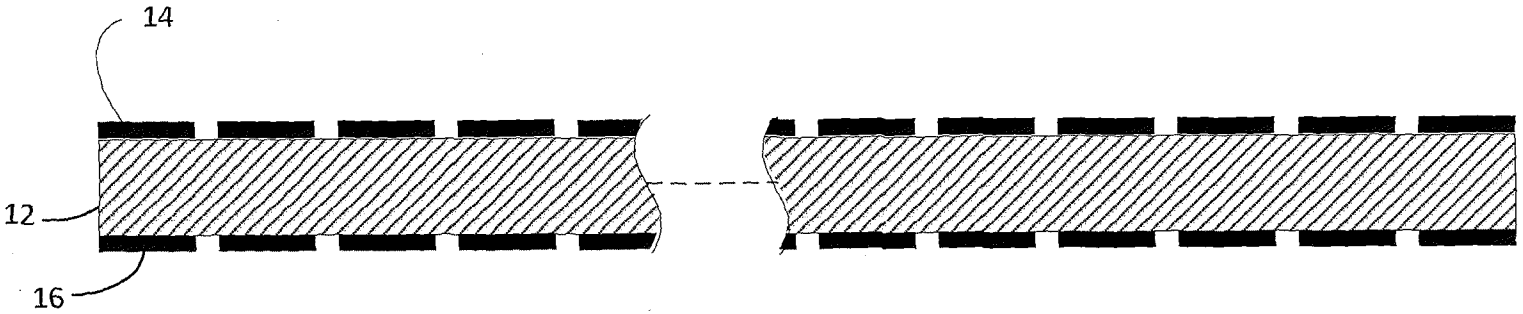
FIG. 7 illustrates a linear antenna array incorporating a dielectric.

In another example, illustrated in FIG. 7, a linear antenna array is provided. In this example, the polarization devices may comprise N electrode pairs 14*a*, 16*a* which are placed adjacent to one another along a segment $-l \le z \le l$ of the z axis of a Cartesian coordinate system. Each electrode pair 14*a*, 16*a* may be aligned on opposite sides of a dielectric rod 12 with a rectangular cross section. A passive feed network may be provided that receives a Radio-Frequency (RF) signal that oscillates at a frequency $\omega/2\pi$. The feed network distributes the RF signal to the electrodes with a phase that has the dependence arcsin $h(\omega z_j/u)$ on the positions $z_j$ of the centres of the electrodes, where u is a constant speed exceeding the speed of light in vacuo, and j=1, 2, . . . , n. Such a feed network generates a moving distribution of polarization within the dielectric strip: a distribution that propagates along the z-axis smoothly when $n \gg \omega l/(\pi u)$, i.e., when the number of polarization devices within a wavelength $2\pi u/\omega$ of the resulting travelling wave sufficiently exceeds unity. If the polarization devices in addition oscillate in phase with a second frequency $\Omega/2\pi$, then the polarization distribution thus generated would have the form:

$$P(x, t)=s(x, y)\cos(\Omega t)\cos[\omega t-\arcsin h(\omega z/u)],\ -l\le z\le l \tag{4}$$

where s(x, y) is a vector field that vanishes outside a finite region of the (x, y)-plane representing the cross section of the dielectric rod.

Figure 8:
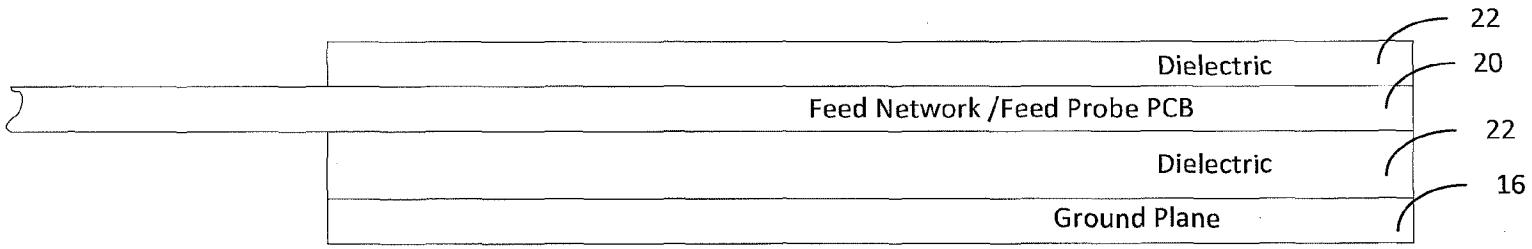
FIG. 8 illustrates a cross section of volume polarization current distribution radiator according to one aspect of the present invention.
Figure 9:
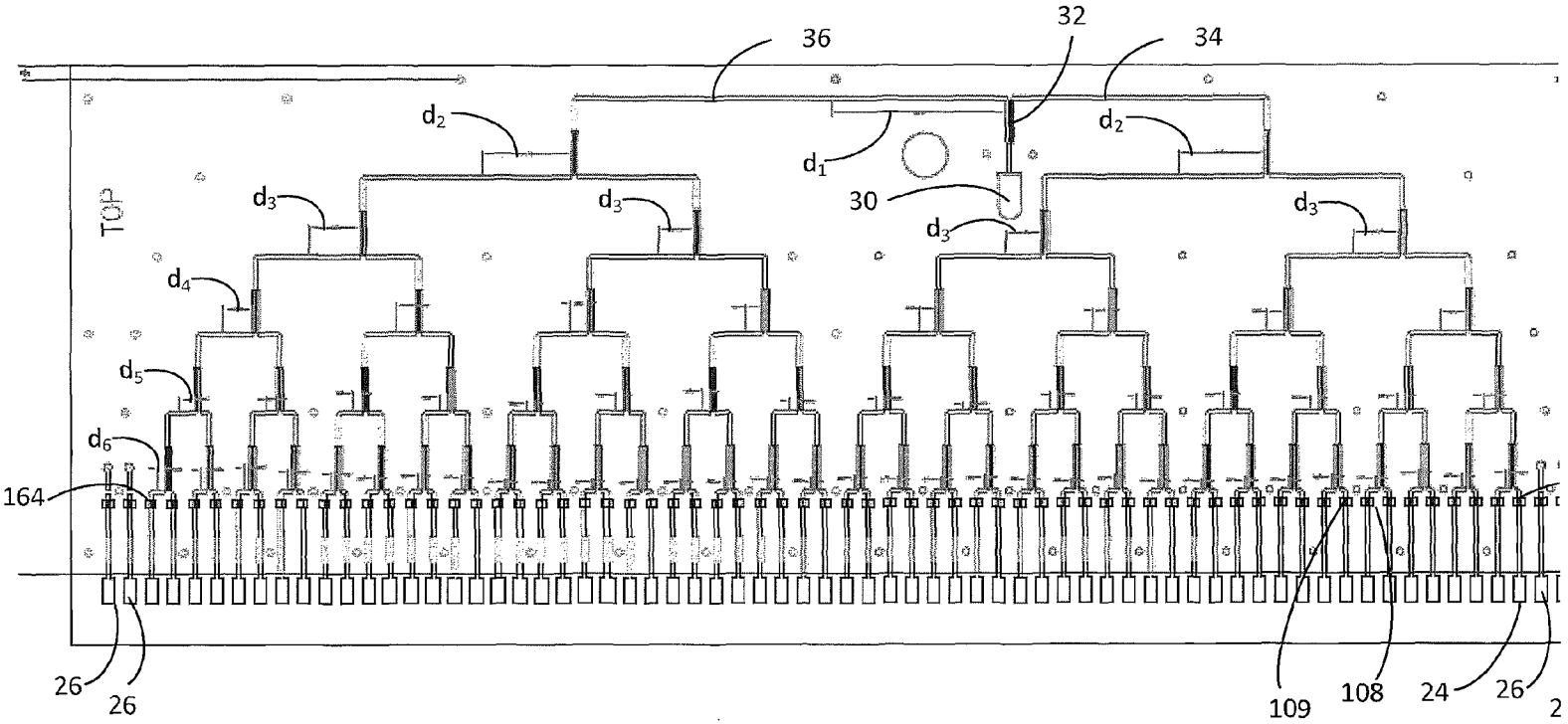
FIG. 9 illustrates a PCB Layout for another example of a volume polarization current distribution radiator according to another aspect of the present invention.

In another example illustrated in FIG. 8, a volume polarization current distribution radiator comprises a dielectric strip 22, a feed probe PCB 20, a second dielectric strip 22, and a ground plane 16. The feed probe PCB 20 includes a plurality of feed probes 24 (FIG. 9). In this example, each feed probe 24 is a polarization device which is sandwiched between dielectric strips. In one example, the feed probe PCB 20 may also incorporate a feed network, or a portion of a feed network. Other displacement current polarization devices may also be used.

The number of polarization devices in a radiator may vary. In one example, thirty-two polarization devices are used in combination with a dielectric strip to form a radiator. In another example illustrated in FIG. 9, sixty-four polarization devices are used in combination with a dielectric strip.

Additionally, the present invention is not limited to dielectrics in the form of a strip, or polarization devices in the form of an array. A dielectric strip is one preferred form of a dielectric solid. Other dielectric solids may also support a travelling polarization current distribution. It is contemplated that polarization devices may be embedded in, or otherwise coupled to, dielectric solids having shapes other than strips of dielectric material.

One embodiment of the invention includes a passive feed network to couple a power amplifier, or other RF source, to the plurality of polarization devices. The feed network may have one input from the power amplifier and may have a plurality of outputs. Each output may be coupled to an individual polarization device. Alternatively, one or more outputs of the feed network may be coupled to a sub-array of two or more polarization devices. The terms "input" and "output" refer to the transmit direction of operation. Because the feed network and polarization devices are passive, in some cases, such as non-accelerated, non-superluminal examples, reciprocity may apply, and this structure would then also work as a receive feed network, where received RF signals would induce a volume distribution current in the dielectric, which would impart a voltage on the polarization devices. The voltages imparted on a plurality of polarization devices would be combined by the feed network and output to a receiver.

In one example, the feed network may include power dividers to create an amplitude distribution, and may include transmission lines of varying length to create phase relationships. In another example, dielectric elements may be used to create the phase relationships. In another example, the phase relationships may be created by adjustable phase shifters. The amplitude distribution and phase relationships between the input and the plurality of outputs is referred to herein as the excitation profile.

The feed network includes power divider elements and phase adjustment elements to apply a desired excitation profile to the polarization devices. In the case of the circular radiator, this produces a stepped approximation to the sinusoidal polarization-current wave by supplying the jth (j=1, 2, 3 . . . ) polarization device with a voltage:

$$V_j=V_0\cos[\eta(j\Delta t-t)]\cos\Omega t \tag{7}$$

Here, $\eta \equiv m\omega$ and $\Delta t \equiv \Delta\phi/\omega$, where $\Delta\phi$ is the angle subtended by the effective center separation of adjacent polarization devices. The speed v with which the polarization current distribution propagates is set by adjusting $\Delta t$. In the examples of feed networks described herein, adjusting $\Delta t$ is accomplished by adjusting phase relationships.

One advantageous application of the foregoing feed network and volume source array is the production of superluminal sources of electromagnetic radiation. In such an application, the $\Delta t$ is reduced such that the speed v with which the polarization current distribution propagates exceeds the speed of light. It is important to note that ions themselves do not exceed the speed of light, but the local propagation of the polarization current distribution is moving faster than the speed of light.

For example, consider a simplified, illustrative example where the volume polarization current displacement radiator has thirty polarization devices where the centers of the polarization devices are separated by one centimeter. In this example, the radiator is thirty centimeters ($3.0\times10^{-1}$ m) long. Because the speed of light in a vacuum is approximately $3.0\times10^{8}$ m/s, the time it would take for light to travel from one end of the radiator to the other in a vacuum would be $10^{-9}$ seconds, or one nanosecond. If the polarization devices to be energized at time delay intervals of 100 picoseconds, the volume polarization current distribution would take three nanoseconds to propagate across the dielectric strip of the radiator, which is slower than it would take light to travel the length of the radiator. If, on the other hand, the time delay interval was reduced from 100 picoseconds to 10 picoseconds, the volume polarization current distribution would take three hundred picoseconds to propagate across the radiator, which is less time than it would take for light to travel the same distance. Thus, the excitation profile may result in superluminal or non-superluminal distribution propagation velocities.

In preparing an excitation profile, the designer may vary: the driving frequency, $\omega$, and the phase difference between neighbouring electrodes, $\Delta\phi$, and the electrode separation, $\alpha$. With these variables, the speed at which the volume displacement current distribution propagates, v, may be expressed as $v=\omega\alpha/\Delta\phi$.

For example, element separation $\alpha$=0.05 m, phase difference $\Delta\phi=\pi/20$ (or 9°), and frequency $\omega=2\pi\times300$ MHz, thereby giving $v=3\times10^8$ m/s, approximately the speed of light. Increasing element separation, or decreasing phase difference, would cause the current distribution to propagate at superluminal speeds.

In the above examples, the feed network energizes the polarization devices progressively with a constant time delay interval between polarization devices. This results in a current distribution velocity that is constant. At times, however, it may be desirable to have a current distribution that appears to accelerate. This may be done by using a curved or circular array or a modified feed network. For example, even though the current distribution velocity is constant when an array is excited by a progressive feed network with constant delay intervals, by virtue of the geometry of the array, when such a feed network is applied to a curved or circular array, the current distribution velocity will appear to accelerate.

In another example, acceleration of the volume polarization current distribution may be achieved in linear arrays (and other arrays) by using a feed network that energizes the array elements according to an excitation profile that causes acceleration of the volume polarization current distribution. The acceleration profile is a type of phase and amplitude distribution which causes the polarization current distribution to accelerate during at least a portion of the propagation across the radiator. To achieve acceleration, the time delay intervals between at least some adjacent polarization devices are shortened relative to the time intervals between other adjacent polarization devices. Indeed, a preferred embodiment is to have the time delay interval between polarization devices progressively reduced across at least a portion of the antenna array. By progressively reducing time interval between adjacent exciting elements, while keeping the distance between the centers of the adjacent polarization devices equally spaced, the polarization current distribution may be made to accelerate. In one preferred embodiment, the polarization current distribution is made to accelerate from a non-superluminal speed to a superluminal speed. In another example, some variation in spacing of the exciting elements may be introduced to affect the propagation velocity of the polarization current distribution.

In one example, the feed network may be fabricated on a PCB. The input port is coupled to a "tree" of power dividers and transmission lines. A trace on a printed circuit board is considered a "transmission line" when its length becomes electrically long relative to the signal being carried. Whether a trace is electrically long depends on the length of the trace, the wavelength of the signal being propagated, and the propagation velocity of signals on the trace. The propagation velocity of a trace on a printed circuit board depends, in part, on the effective dielectric constant of the substrate of the printed circuit board. One rule of thumb is that a trace on a PCB may be considered a transmission line when its length exceeds one-twentieth of the wavelength of the signal.

The lengths of the transmission lines are selected to impart a desired time delay (phase shift) to the signal provided on the input of the feed network relative to a plurality of output ports. The power dividers are selected to impart a desired power distribution across the output ports. The power distribution may be constant, tapered, or have some other suitable power distribution.

An example of a feed network having a plurality of levels between the input port and a plurality of output ports is illustrated in FIG. 9. Feed probes are also illustrated. In the first level, an input port 30 is coupled to a power divider 32. The power divider may be a 1:2 divider. A first output of the power divider 32 is coupled to a first transmission line 34, and a second output of the power divider is coupled to a second transmission line 36. The difference in length between the first transmission line 34 and the second transmission line 36 is length $d_1$. At the end of the first level of the feed network, the signal on the second transmission line 36 would experience a time delay proportional to the distance $d_1$ relative to the first transmission line 34. This time delay results in a phase difference between the signals on the first transmission line 34 and the second transmission line 36.

A second level of the feed network has two power dividers 38 (one coupled to each of the transmission lines of the first level), each of which divides the signals again. The second level has transmission lines which impose a second additional length $d_2$ to one of the outputs of each of the second level power dividers. At the end of the second level, the rightmost branch is delayed relative to the leftmost branch by a distance $d_1+d_2$. The left-center branch is delayed by $d_2$, and the right-center branch is delayed by $d_1$.

At the third level, there are four power dividers. To improve clarity, the power dividers and transmission lines from the third level on are not individually marked with reference characters. Each power divider is coupled to transmission lines having a length differential of $d_3$. The same process continues with respect to a fourth level, a fifth level, and a sixth level. In this example, the outputs of the sixth level comprise output ports which are coupled to feed probes. Since 1:2 power dividers were used at each level, the number of output ports and feed probes is two to the sixth power, which is 64. In this example, the aggregate distances are different. In the illustrated example, the first and last feed probes are bounded on the outside by a pair of dummy feed probes 26. The first output port 101 and the last output port 164 are delayed in phase relative to the input by the aggregate distance an RF signal traveled along the transmission lines from the input port to the output port and the feed probe. In the illustrated example, output port 164 is delayed relative to output port 101 by the sum of additional lengths of $d_1+d_2+d_3+d_4+d_5+d_6$. In another example, output port 108 is delayed with respect to output port 101 by $d_4+d_5+d_6$, and delayed with respect to output port 107 by $d_6$ only.

Differential differences may be chosen such that the difference in total aggregate transmission line length experienced between any two adjacent output ports is $d_6$. For example output port 109 experiences an additional delay of length $d_3$ relative to output port 101, which is length $d_6$ longer than the aggregate of the differential lengths $d_4+d_5+d_6$, experienced by output port 108. If distance $d_6$ is made to be less than a distance separating center of the feed probes, then the propagation velocity of the volume source current distribution will be superluminal.

In the examples of FIG. 9, the additional differential delay added at each level of the feed network is the same. For example, each of the differential lengths added at the fourth level is equal to $d_4$ However, alternate examples have different differential lengths at within a level of a feed network, so that the differences in total aggregate transmission line length experienced by adjacent output ports changes. If the changes are to progressively reduce the differences in the aggregate transmission line length, the phase differences between output ports will be reduced and the traveling polarization current distribution will accelerate.

In another embodiment, the power dividers are replaced by combination differential phase shifter-power dividers.

Differential phase shifters in a corporate feed network are illustrated, for example, in U.S. Pat. No. 7,830,307, the disclosure of which is incorporated by reference. The feed network of the '307 patent is used in combination arrays of point source radiators, not a continuous traveling current distribution radiator. When adjustable phase shifters are used, phase differences between output ports may be adjusted. Such an embodiment may have pre-phasing provided by differences in lengths of transmission line, as illustrated in the above example, but such pre-phasing is not always desirable.

The passive feed network need not be static. That is, the passive elements may be adjusted to change the phase relationships and power divisions produced by the passive elements in the feed network. For example, a differential phase shifter may be adjusted mechanically, electromechanically, or electromechanically by remote control. See, e.g., U.S. Pat. No. 8,018,390, this disclosure of which is incorporated by reference. Once again, the feed network of the '390 patent is used in combination with a phased array of point sources, and is not directly combinable with a traveling volume source radiator such as disclosed in the present application.

As is evident from the foregoing description, certain aspects of the present invention are not limited by the particular details of the examples illustrated herein, and it is therefore contemplated that other modifications and applications, or equivalents thereof, will occur to those skilled in the art. It is accordingly intended that the claims shall cover all such modifications and applications that do not depart from the spirit and scope of the present invention.

Other aspects, objects and advantages of the present invention can be obtained from a study of the drawings, the disclosure and the appended claims.

What is claimed is:

1. An antenna, comprising:

a) a volume polarization current radiator, including:
   i) a dielectric solid, and
   ii) a plurality of closely-spaced excitation elements, each excitation element being configured to induce a volume polarization current distribution in the dielectric solid proximate to the excitation element when a voltage is applied to the excitation element; and b) a feed network coupled to the volume polarization current radiator, the feed network comprising:
   i) a first port;
   ii) a plurality of second ports, each of the plurality of second ports being coupled to at least one of the plurality of excitation elements; and
   iii) a plurality of passive power divider elements and a plurality of passive delay elements coupling the first port and the plurality of second ports, the plurality of power divider elements and the plurality of phase delay elements being configured such that a radio-frequency signal that is applied to the first port experiences a progressive change of phase as it is coupled to the plurality of second ports so as to cause the volume polarization current distribution to propagate along the dielectric solid.

2. The antenna of claim 1, wherein the progressive change of phase comprises a progressive change of time delay between the first port and at least some of the plurality of second ports.

3. The antenna of claim 1, wherein the progressive change of phase comprises adding phase delay in approximately equal amounts.

4. The antenna of claim 1, wherein the progressive change of phase comprises adding phase delay in diminishing amounts.

5. The antenna of claim 1, wherein the dielectric solid is linear strip, and the plurality of closely-spaced excitation elements comprises a linear array.

6. The antenna of claim 1, wherein the dielectric solid is curved strip, and the plurality of closely-spaced excitation elements comprises a curved array.

7. The antenna of claim 1, wherein the dielectric solid is circular strip, and the plurality of closely-spaced excitation elements comprises a circular array.

8. The antenna of claim 1, wherein the plurality of power divider elements and the plurality of phase delay elements are configured such that when a radio-frequency signal is applied to the first port, the phase of the radio-frequency signal is progressively changed as it is coupled to the plurality of second ports so as to cause the volume polarization current distribution to propagate along the dielectric solid at a velocity less than the speed of light in a vacuum.

9. The antenna of claim 1, wherein the plurality of power divider elements and the plurality of phase delay elements are configured such that when a radio-frequency signal is applied to the first port, the phase of the radio-frequency signal is progressively changed as it is coupled to the plurality of second ports so as to cause the volume polarization current distribution to propagate along the dielectric solid at a velocity greater than the speed of light in a vacuum.

10. The antenna of claim 1, wherein the plurality of power divider elements and the plurality of phase delay elements are configured such that when a radio-frequency signal is applied to the first port, the phase of the radio-frequency signal is progressively changed as it is coupled to the plurality of second ports so as to cause the volume polarization current distribution to accelerate while propagating along the dielectric solid.

11. The antenna of claim 1, wherein the plurality of closely spaced excitation elements comprises a first excitation element and a second excitation element, a) the first excitation element being adjacent to the second excitation element, wherein a center of the first excitation element is separated from a center of a second excitation element by an element distance;

b) the feed network imposing a first aggregate amount of time delay between the first port and the first excitation element; and c) the feed network imposing a second aggregate amount of time delay between the first port and the second excitation element, the first aggregate amount of time delay being less than the second aggregate amount of time delay.

12. The antenna of claim 11, wherein the element distance is greater than a difference between the first aggregate amount of time delay and the second aggregate amount of time delay.

13. The antenna of claim 11, wherein the element distance is less than a difference between the first aggregate amount of time delay and the second aggregate amount of time delay.

14. The antenna of claim 11, wherein the plurality of closely spaced excitation elements further comprises a third excitation element;

a) the second excitation element being adjacent to the third excitation element, wherein the center of the second excitation element is separated from a center of a third excitation element by the element distance;

b) the feed network imposing a third aggregate amount of time delay between the first port and the third excitation element, the third aggregate amount of time delay being greater than the second aggregate amount of time delay.

15. The antenna of claim 11, wherein the element distance is greater than a difference between the first aggregate amount of time delay and the second aggregate amount of time delay; and a difference between the second aggregate amount of time delay and the third aggregate amount of time delay is less than the difference between the first aggregate amount of time delay and the second aggregate amount of time delay.

16. The antenna of claim 1, wherein at least one of the plurality of passive delay elements comprises a fixed-length transmission line that imparts a fixed amount of time delay.

17. The antenna of claim 1, wherein at least one of the plurality of passive delay elements comprises an adjustable phase shifter that imparts a variable amount of time delay.

18. The antenna of claim 1, wherein at least one of the plurality of passive delay elements comprises an adjustable phase shifter that imparts a variable amount of time delay and at least one of the plurality of phase delay elements comprises a fixed-length transmission line that imparts a fixed amount of time delay.

19. An method of producing electromagnetic radiation, the method comprising:

a) providing a volume polarization current radiator, the volume polarization current radiator including:
   i) a dielectric solid, and
   ii) a plurality of closely-spaced excitation elements, each excitation element being configured to induce a volume polarization current distribution in the dielectric solid proximate to the excitation element when a voltage is applied to the excitation element;

b) coupling a feed network to the volume polarization current radiator, the feed network comprising:
   i) a first port;
   ii) a plurality of second ports, each of the plurality of second ports being coupled to at least one of the plurality of excitation elements; and
   iii) a plurality of passive power divider elements and a plurality of passive delay elements coupling the first port and the plurality of second ports;

c) the plurality of power divider elements and the plurality of phase delay elements progressively changing phase between the first port and the plurality of second ports; and d) applying a radio-frequency signal to the first port, the radio-frequency signal propagating through the feed network to the plurality of second ports thereby causing a volume polarization current distribution to propagate along the dielectric solid.

20. The method of claim 19, wherein the steps of progressively changing phase and applying radio-frequency signal causes the volume polarization current distribution to propagate along the dielectric solid at a velocity less than the speed of light in a vacuum.

21. The method of claim 19, wherein the steps of progressively changing phase and applying radio-frequency signal causes the volume polarization current distribution to propagate along the dielectric solid at a velocity greater than the speed of light in a vacuum.

22. The method of claim 19, wherein the steps of progressively changing phase and applying radio-frequency signal causes the volume polarization current distribution to accelerate while propagating along the dielectric solid.

23. The method of claim 19, wherein the step of progressively changing phase further comprises varying phase differences between the second ports.

* * * * *